US009416506B2

(12) United States Patent
Castro

(10) Patent No.: US 9,416,506 B2
(45) Date of Patent: Aug. 16, 2016

(54) APPARATUS AND METHOD FOR RAPIDLY IMMOBILIZING A LAND VEHICLE

(71) Applicant: Pacific Scientific Energetic Materials Company (Arizona) LLC, Chandler, AZ (US)

(72) Inventor: Mynor J. Castro, Chandler, AZ (US)

(73) Assignee: Pacific Scientific Energetic Materials Company (Arizona) LLC, Chandler, AZ (US)

( * ) Notice: Subject to any disclaimer, the term of this patent is extended or adjusted under 35 U.S.C. 154(b) by 0 days.

(21) Appl. No.: 15/018,630

(22) Filed: Feb. 8, 2016

(65) Prior Publication Data

US 2016/0153156 A1 Jun. 2, 2016

Related U.S. Application Data

(63) Continuation of application No. 14/477,805, filed on Sep. 4, 2014, now Pat. No. 9,255,367.

(60) Provisional application No. 61/873,812, filed on Sep. 4, 2013.

(51) Int. Cl.
*E01F 13/00* (2006.01)
*E01F 13/12* (2006.01)

(52) U.S. Cl.
CPC ..... *E01F 13/12* (2013.01)

(58) Field of Classification Search
CPC ..... E01F 13/12; E01F 15/10; E01F 15/14
USPC ..... 404/6; 256/13.1
See application file for complete search history.

(56) References Cited

U.S. PATENT DOCUMENTS

| | | | | |
|---|---|---|---|---|
| 4,145,786 | A | 3/1979 | Myers | |
| 5,452,962 | A | 9/1995 | Greves | |
| 5,498,102 | A | 3/1996 | Bissell | |
| 6,322,285 | B1 * | 11/2001 | Ben | E01F 13/12 404/6 |
| 6,409,420 | B1 * | 6/2002 | Horton | E01F 13/123 404/6 |
| 7,785,032 | B2 * | 8/2010 | Segal | E01F 13/12 404/6 |
| 8,147,163 | B2 * | 4/2012 | Bare | E01F 13/12 404/6 |
| 2006/0140715 | A1 * | 6/2006 | Lyddon | E01F 13/12 404/6 |
| 2009/0263190 | A1 | 10/2009 | Segal | |
| 2010/0086349 | A1 | 4/2010 | Martinez et al. | |
| 2010/0178104 | A1 | 7/2010 | Bare et al. | |
| 2010/0284739 | A1 * | 11/2010 | Allsopp | E01F 13/12 404/6 |
| 2011/0030540 | A1 | 2/2011 | Martinez et al. | |
| 2011/0097147 | A1 | 4/2011 | Castro et al. | |
| 2012/0237293 | A1 | 9/2012 | McCoy et al. | |
| 2012/0251237 | A1 * | 10/2012 | Dandy | E01F 13/12 404/6 |

OTHER PUBLICATIONS

International Application No. PCT/US2014/054149, International Search Report & Written Opinion, 9 pages, Dec. 11, 2014.

* cited by examiner

*Primary Examiner* — Raymond W Addie
(74) *Attorney, Agent, or Firm* — Perkins Coie LLP

(57) ABSTRACT

An apparatus to be positioned at the side of a roadway for ensnaring tires of an oncoming land vehicle. The apparatus comprises a plurality of segments flexibly attached end-to-end. At least a subset of the segments further comprise a spike ramp. The segments are connected at the ends via hinges. The segments are adapted to house a net package in a stowed-away configuration. The net package includes a set of spikes tethered to netting. A deployment hose is connected to a subset of the segments to cause the segments to become unstacked for deployment when the deployment hose is inflated.

19 Claims, 17 Drawing Sheets

APPARATUS AND METHOD FOR RAPIDLY IMMOBILIZING A LAND VEHICLE

CROSS-REFERENCE TO RELATED APPLICATION

The present application is a continuation of U.S. patent application Ser. No. 14/477,805 titled "Apparatus And Method For Rapidly Immobilizing A Land Vehicle" filed on Sep. 4, 2014 now U.S. Pat. No. 9,255,367, which claims priority to and benefit from U.S. Provisional Patent Application No. 61/873,812 titled "Apparatus And Method For Rapidly Immobilizing A Land Vehicle" filed on Sep. 4, 2013, the entire content of each of which is herein expressly incorporated by reference.

TECHNICAL FIELD

The present disclosure relates generally to an apparatus and a method for affecting movement of a land vehicle. More particularly, the present disclosure relates to apparatuses, systems and methods for deterring, slowing, disabling, restraining and/or immobilizing a motor vehicle by entangling one or more tires of the vehicle.

BACKGROUND

Conventional devices for restricting the movement of land vehicles include barriers, tire spike strips, caltrops, snares and electrical system disabling devices. For example, conventional spike strips include spikes projecting upwardly from an elongated base structure that is stored as either a rolled up device or an accordion type device. These conventional spike strips are tossed or thrown on a road in anticipation that an approaching target vehicle will drive over the spike strip. Successfully placing a conventional spike strip in the path of a target vehicle results in one or more tires of the target vehicle being impaled by the spike(s), thereby deflating the tire(s) and making the vehicle difficult to control such that the driver is compelled to slow or halt the vehicle.

Conventional spike strips may be used by first response personnel, law enforcement personnel, armed forces personnel or other security personnel. It is frequently the case that these personnel must remain in close proximity when deploying spike strips. For example, a conventional method of deploying a spike strip is to have the personnel toss the spike strip in the path of an approaching target vehicle. This conventional method places the security personnel at risk insofar as the driver of the target vehicle may try to run down the security personnel or the driver may lose control of the target vehicle while attempting to maneuver around the spike strip and hit the security personnel. Further, rapidly deflating only one of the steering tires may cause a target vehicle to careen wildly and possibly strike nearby security personnel, bystanders, or structures.

There are a number of disadvantages of conventional spike strips including difficulty deploying the strip in the path of a target vehicle and the risk that one of the spikes could injure security personnel while deploying or retracting the strip. The proximity of the security personnel to the target vehicle when it runs over strip places the security personnel at risk of being struck by the target vehicle. Further, allowing the strip to remain deployed after the target vehicle passes the strip places other vehicles at risk of running over the strip.

DETAILED DESCRIPTION

Specific details of embodiments according to the present disclosure are described below with reference to devices for deflating tires of an oncoming land vehicle. Other embodiments of the disclosure can have configurations, components, features or procedures different than those described in this section. A person of ordinary skill in the art, therefore, will accordingly understand that the disclosure may have other embodiments with additional elements, or the disclosure may have other embodiments without several of the elements shown and described below with reference to the figures.

Figure 1:
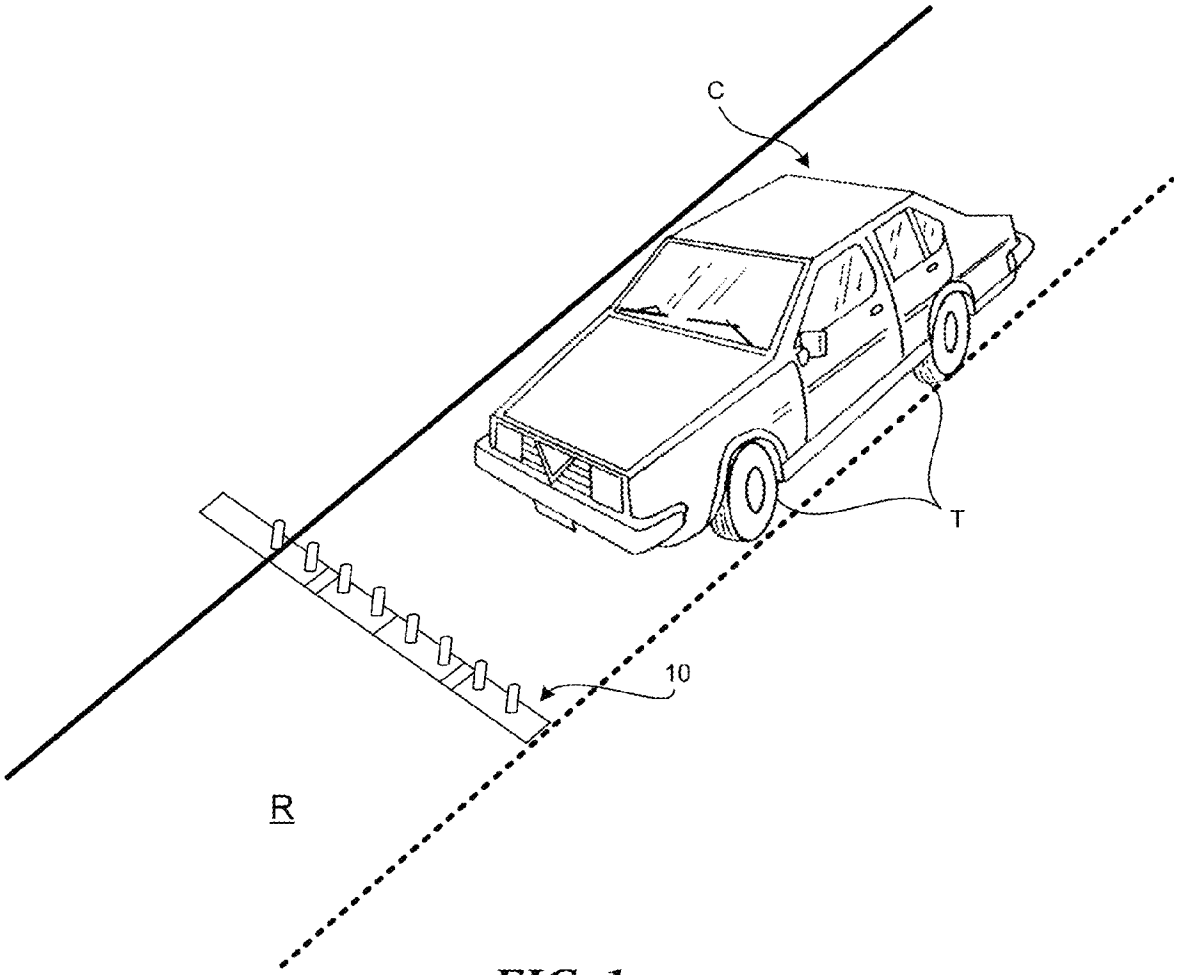
FIG. 1 is a schematic perspective view of a land vehicle approaching a device according to an embodiment of the present disclosure.

FIG. 1 is a schematic perspective view of a land vehicle approaching a device 10 according to an embodiment of the present disclosure. First response personnel, law enforcement personnel, armed forces personnel or other security personnel may use the device 10 to slow, disable, immobilize and/or restrict the movement of the land vehicle. Examples of land vehicles may include cars, trucks or any other vehicles that use tires to transport the land vehicle. The term "ground" may refer to natural or manmade terrain including improved roadways, gravel, sand, dirt, etc. FIG. 1 shows a car C supported, steered, and/or accelerated by pneumatic tires T relative to a roadway R.

Certain embodiments according to the present disclosure deploy the device 10 in the expected pathway of a target vehicle, e.g., the car C. The undeployed device 10 may be placed on the ground, e.g., on or at the side of the road R, and then armed. For example, the device 10 can be armed by making a power source available in anticipation of deploying the device 10. The device 10 is deployed, e.g., extended across the expected pathway of the target vehicle, as the vehicle approaches the device 10. The device 10 may be deployed when the target vehicle is a short distance away, e.g., less than 100 feet. This may avoid alerting the driver to the presence of the device 10 and thus make it more likely that the target vehicle will successfully run over the device 10. Similarly, remotely or automatically deploying the device 10 may reduce the likelihood that the driver will notice the device 10 or take evasive action to avoid running over the device 10. Remotely deploying the device 10 also allows the device operator (not shown) to move away from the target vehicle and thereby reduce or eliminate the likelihood of the vehicle striking the operator.

Figure 2A:
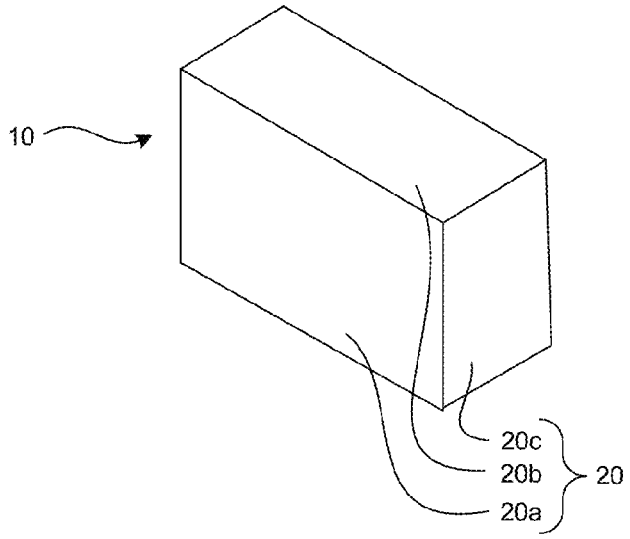
FIGS. 2A-2D are schematic perspective views showing an exemplary device that may be utilized with an embodiment of the present disclosure in an unarmed arrangement, an armed arrangement, and a deployed arrangement, respectively.
Figure 2B:
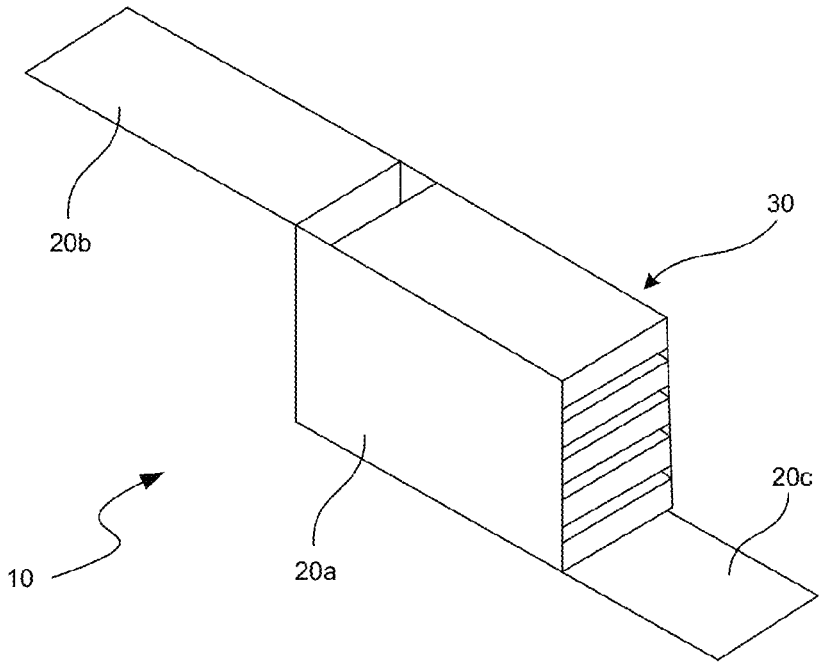

FIGS. 2A-2D illustrates a layout of the apparatus 10 in undeployed and partially deployed states according to embodiments of the disclosure. The apparatus 10 includes a housing 20 for transporting and/or handling the overall device 10 and for storing the segments. In some embodiments, the housing 40 may be a box-type configuration. As can be seen in FIG. 2B, the housing 20 includes a base or bottom portion 20*a* and a closable lid 20*b* that is opened during the process of deployment. In some embodiments, the closable lid can be divided into two parts, a top portion 20*b* and a front portion 20*c*. The lid can be manually opened to arm or activate the device, or in other embodiments, a switch can be tripped or otherwise a remote controlled signal can be used to arm the device and cause the lid to become opened. In some embodiments, the housing 40 can be made so as to be watertight when the apparatus is in the un-deployed state. The housing 40 also may include carrying handles or otherwise may be configured for easy carrying and transportation when the apparatus is in an undeployed state.

Figure 2C:
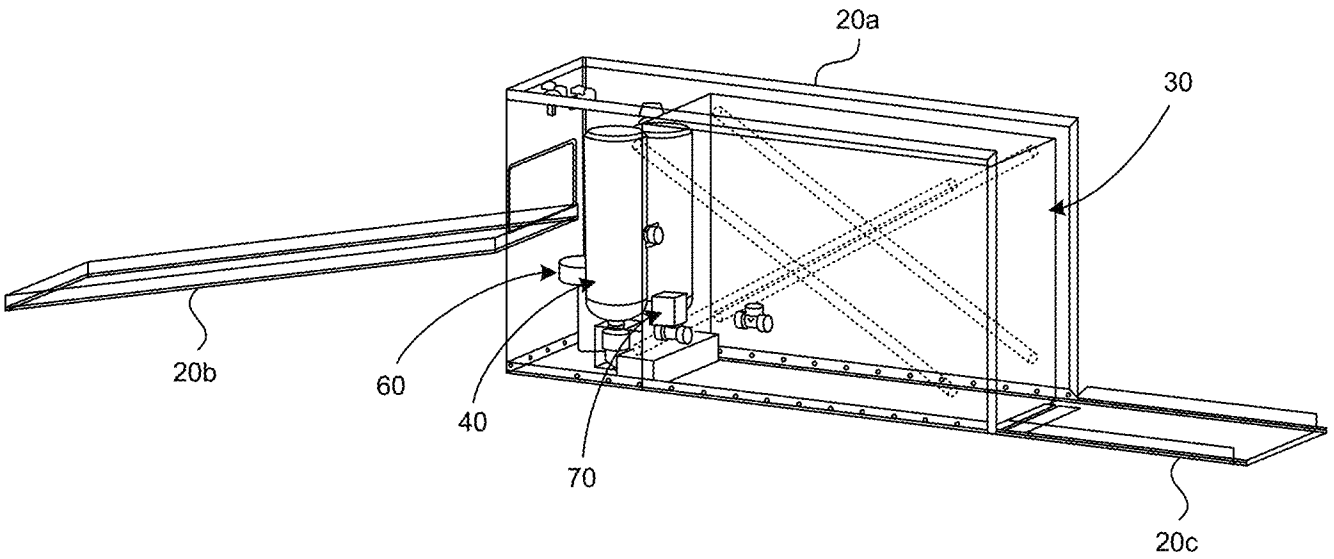

As shown in FIG. 2B, in an undeployed state, the housing 20 contains a series of segments in a netting package 30. FIG. 2C provides a transparent view of the housing 20 with the netting package 30 removed, but with other components remaining within the housing, including an inflation device 40, a retractor device 60 and a power source 70 (such as a battery pack). When the apparatus 10 is deployed these components operate to unfurl the segments out of the housing 20 and onto the roadway in the expected path of an oncoming vehicle, and then to retract the segments out of the roadway after the vehicle has made contact with the segments.

Figure 2D:
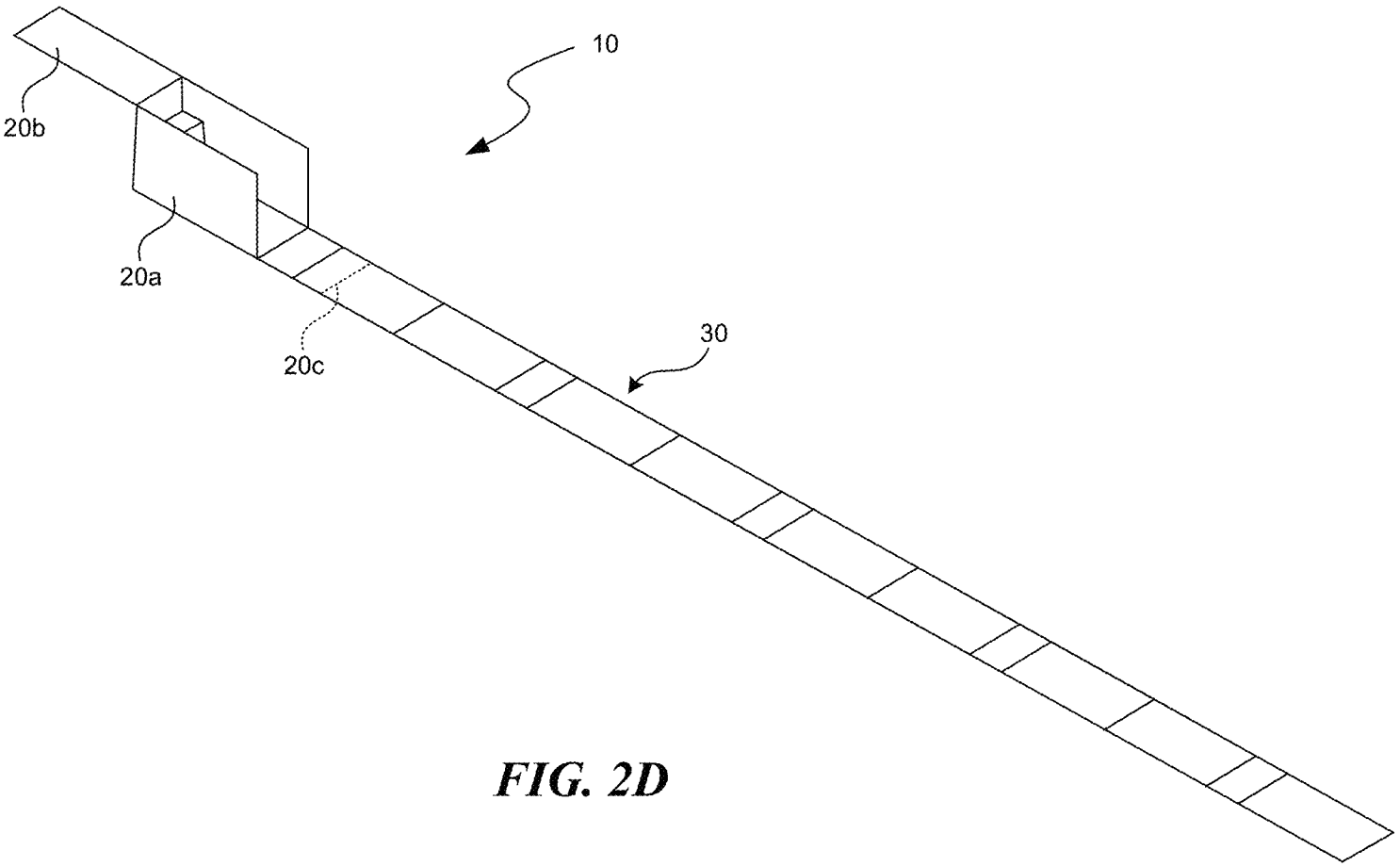

FIG. 2D illustrates the apparatus 10 in a partially deployed state. As can be seen, the plurality of segments in the netting package are arranged linearly when the apparatus is deployed. The segments are coupled together by coupling links, such as link 35. The segments are configured to be lodged across a roadway (or other ground surface) as the apparatus is being deployed.

Figure 3A:
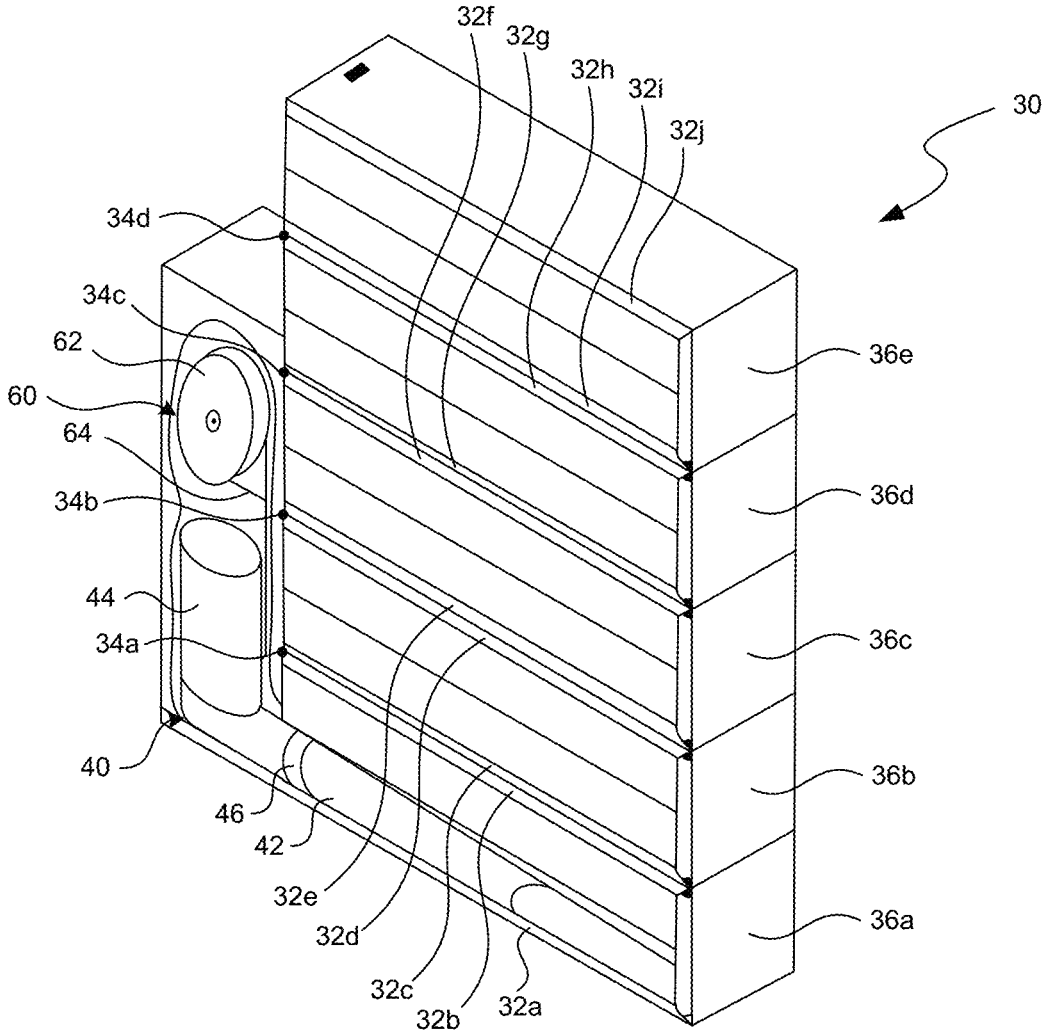
FIG. 3A is a perspective view of a netting package and an exemplary inflator device and an optional retractor device that may be utilized with an embodiment of the present disclosure before the device is deployed.

FIG. 3A is a perspective view of the netting package 30 including the inflator device 40 and the retractor device 60 according to an embodiment of the present disclosure before the device 10 is deployed. The netting package 30 includes a plurality of segments 32 (ten plates 32*a*-32*j* are shown in FIG. 3A) that are pivotally coupled by alternating first and second hinges. Individual first hinges 34 (four first hinges 34*a*-34*d* are shown in FIG. 3A) include a single pivot axis between adjacent segments 32, and individual second hinges 36 (five second hinges 36*a*-36*e* are shown in FIG. 3A) include two separate pivot axes spaced by a link between adjacent segments 32. According to the embodiment shown in FIG. 3A, second hinge 36*a* pivotally couples segments 32*a* and 32*b*, first hinge 34*a* pivotally couples segments 32*b* and 32*c*, second hinge 36*b* pivotally couples segments 32*c* and 32*d*, first hinge 34*b* pivotally couples segments 32*d* and 32*e*, second hinge 36*c* pivotally couples segments 32*e* and 32*f*, first hinge 34*c* pivotally couples segments 32*f* and 32*g*, second hinge 36*d* pivotally couples segments 32*g* and 32*h*, first hinge 34*d* pivotally couples segments 32*h* and 32*i*, and second hinge 36*e* pivotally couples segments 32*i* and 32*j*. Accordingly, the netting package 30 includes an articulated series of segments 32 and hinges 34 and 36.

The undeployed or stacked arrangement of the netting package 30 shown in FIG. 3A includes the segments 32*a* through 32*j* overlying one another. In particular, segment 32*j* overlies segment 32*i* (they are separated by second hinge 36*e*), segment 32*i* directly overlies segment 32*h* (they are coupled by first hinge 34*d*), segment 32*h* overlies segment 32*g* (they are separated by second hinge 36*d*), segment 32*g* directly overlies segment 32*f* (they are coupled by first hinge 34*c*), segment 32*f* overlies segment 32*e* (they are separated by second hinge 36*c*), segment 32*e* directly overlies segment 32*d* (they are coupled by first hinge 34*b*), segment 32*d* overlies segment 32*c* (they are separated by second hinge 36*b*), segment 32*c* directly overlies segment 32*b* (they are coupled by first hinge 34*a*), and segment 32*b* overlies segment 32*a* (they are separated by second hinge 36*a*). The spaces between the segments 32 due to the separation provided by the second hinges 36 accommodate penetrators and netting that are part of the segments 32 as will be discussed in greater detail below.

The segments 32 and/or the second hinges 36 can include a base section comprised of fiberglass, corrugated plastic or cardboard, wood, or another material that is suitably strong and lightweight. For example, G10 is an extremely durable makeup of layers of fiberglass soaked in resin that is highly compressed and baked. Moreover, G10 is impervious to moisture or liquid and physically stable under climate change. The base section of the segment 32 should provide a platform suitable for supporting an assembly that includes inflatable hoses, netting, and spikes, as will be described below. The size of the segments 32 may affect how far the netting package 30 extends in the deployed arrangement, e.g., shorter segments 32 may result in a shorter netting package 30 being deployed for a narrow roadway.

The inflator device 40 includes inflatable bladders 42 (two inflatable bladders 42*a* and 42*b* are shown in FIG. 4) that are also accommodated in the spaces between the segments 32 due to the separation provided by the second hinges 36. The inflator device 40 additionally includes a pressure source 44, e.g., a pressurized gas cylinder, gas generator, an accumulator, etc., and a manifold 46 coupling the pressure source 44 to the bladders 42. The bladders 42 are mounted to the segments 32 and, in response to being inflated by the pressure source 44, expand to deploy the netting package 30. Certain embodiments according to the present disclosure include tubular bladders 42 mounted lengthwise along the segments 32 such that, in the stacked arrangement of the netting package 30, the bladders 42 are temporarily creased at the first and second hinges 34 and 36. Accordingly, each bladder 42 defines a series of chambers that may be sequentially inflated starting at the end of the bladder 42 coupled to the manifold 46. As each chamber is inflated, the expanding bladder unstacks, e.g., unfolds, unfurls, or otherwise begins to deploy, adjacent overlying segments 32 until the bladders 42 are approximately fully expanded and the netting package is deployed, e.g., as shown in FIG. 2C. The pivot axes of the first and second hinges 34 and 36 may assist in constraining the netting package 30 to deploying in a plane, e.g., minimizing or eliminating twisting by the netting package 30 about its longitudinal axis when it is being deployed.

The inflator device 40 may also include a sensor (not shown) for sensing an approaching vehicle and automatically deploying the netting package 30. Examples of suitable sensors may include magnetic sensors, range sensors, or any other device that can sense an approaching vehicle and deploy the netting package 30 before of the vehicle arrives at the device 10. The inflator device 40 may alternatively or additionally include a remote actuation device (not shown) for manually deploying the netting package 30. The sensor and/or the remote actuation device may be coupled to the device 10 by wires, wirelessly, or another communication system for conveying a "deploy signal" to the device 10. Examples of wireless communication technology include electromagnetic transmission (e.g., radio frequency) and optical transmission (e.g., laser or infrared).

Figure 3B:
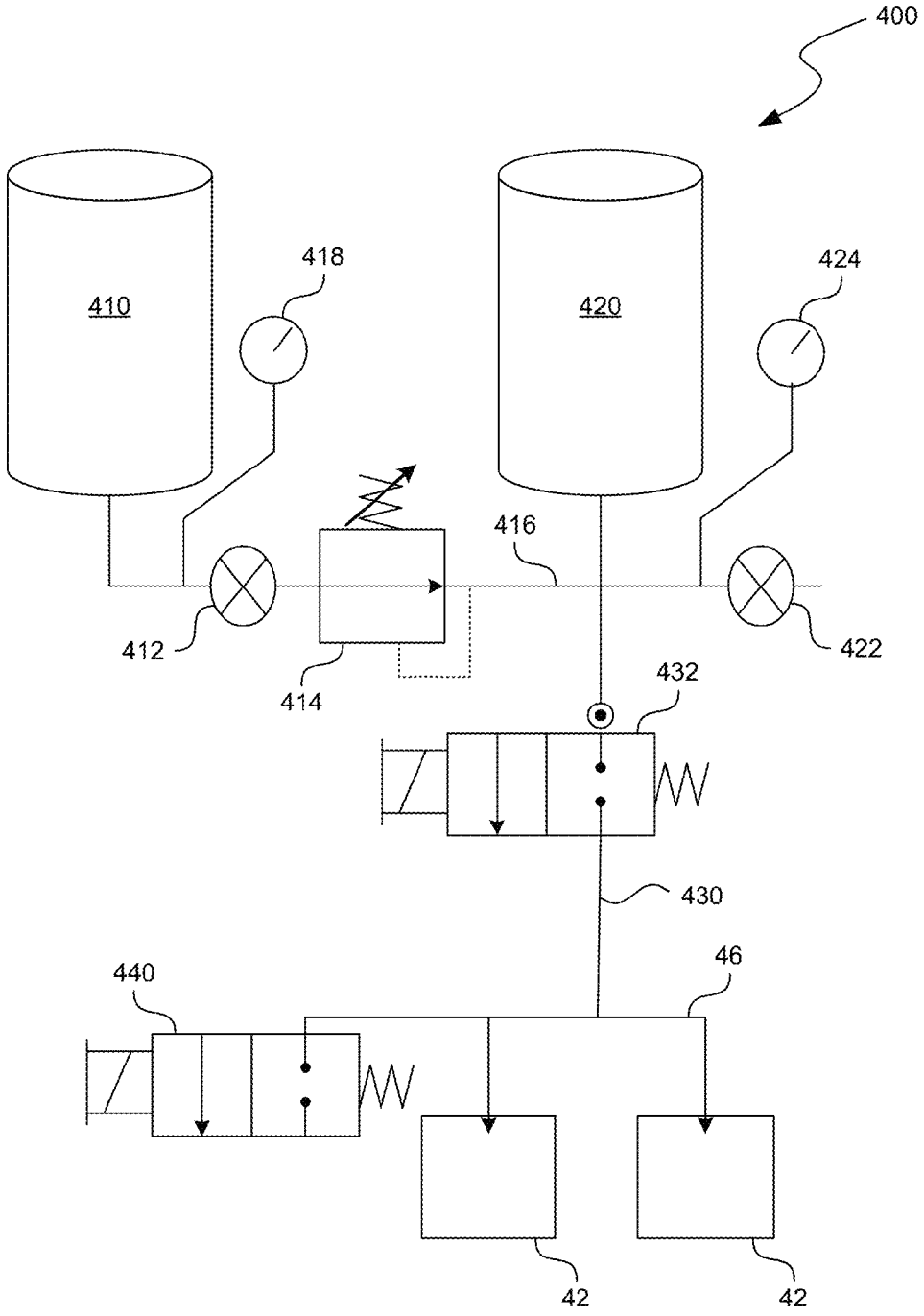
FIG. 3B is a schematic view of an exemplary inflator device that may be utilized with an embodiment of the present disclosure.

FIG. 3B is a schematic view of a multiple discharge, cold gas inflator device 400 according to an embodiment of the present disclosure. The inflator device 400 shown in FIG. 3B includes a high pressure reservoir 410 for supplying a compressed gas, e.g., nitrogen, to an accumulator tank 420. The supply of compressed gas can be controlled by a supply valve 412 and/or a pressure regulator 414 along a supply line 416 coupling the high pressure reservoir 410 and the accumulator tank 420. The supply valve 412 can supply or shutoff a flow of the compressed gas from the high pressure reservoir 410 through the supply line 416. According to certain embodiments of the present disclosure, the high pressure reservoir 410 can have a volume of approximately 50 cubic inches (in.sup.3) and can be initially pressurized to approximately 3,000 pounds per square inch (psi). The accumulator tank 420 can have a volume less than, similar to, or greater than that of the high pressure reservoir 410. For example, certain embodiments of the present disclosure can include an accumulator tank 420 having a slightly larger volume, e.g., approximately 62 in.sup.3, and the pressure regulator 414 can be adjusted to pressurize the accumulator tank 420 to a relatively lower pressure, e.g., to approximately 600 psi. In general, the volume and pressure of the accumulator tank 420 may be related to the volume of the bladders 42 and the desired time for deploying the netting package 30 with the bladders 42. For example, greater deployment pressure and/or volume may reduce the time it takes to deploy the netting package 30 whereas lower deployment pressure and/or volume may provide a more controlled deployment of the netting package 30. A gauge 418 can be coupled to the supply line 416 between the high pressure reservoir 410 and the supply valve 412 to indicate the pressure in the high pressure reservoir 410. Certain other embodiments may use a different gas or mixture of gases, may include reservoirs or tanks with different volume(s), may include fixed or adjustable pressure regulators, and/or may use different pressure(s).

A drain valve 422 coupled to the supply line 416 downstream of the accumulator tank 420 can drain residual pressure in the accumulator tank 420 by opening the supply line 416 to the atmosphere. A gauge 424 can be coupled to the supply line 416 between the supply valve 412 and the drain valve 422 to indicate the pressure in the accumulator tank 420.

Compressed gas for deploying the netting package 30 can flow along a deployment line 430 that couples the supply accumulator tank 420 and the manifold 46. A deployment valve 432 is positioned along the deployment line 430 between the supply accumulator tank 420 and the manifold 46 to control flow of the compressed gas to the netting package 30. According to certain embodiments of the present disclosure, the deployment valve 432 can include a 0.5 inch NPT normally closed solenoid valve with an approximately 15 millimeter orifice, a 1500 psi pressure capability, and can be actuated by a direct current signal, e.g., 24 volts. A signal to deploy the netting package 30 energizes the solenoid of the deployment valve 432 to allow compressed gas in the accumulator tank 420 to flow through the deployment line 430 and the manifold 46 to the bladders 42, thereby deploying the netting package 30. A vent valve 440 coupled to the deployment line 430 downstream of the deployment valve 432 and/or coupled to the manifold 46 can vent compressed gas in the bladders 42 to the atmosphere. According to certain embodiments of the present disclosure, the vent valve 440 can include a 0.125 inch NPT normally closed solenoid valve with an approximately 1.2 millimeter orifice and can also be actuated by a 24 volt direct current signal. A signal to vent the bladders 42 energizes the solenoid of the vent valve 440 to release to atmosphere the gas in the bladders 42, for example, before and/or during operation of the retractor device 60.

Figure 3C:
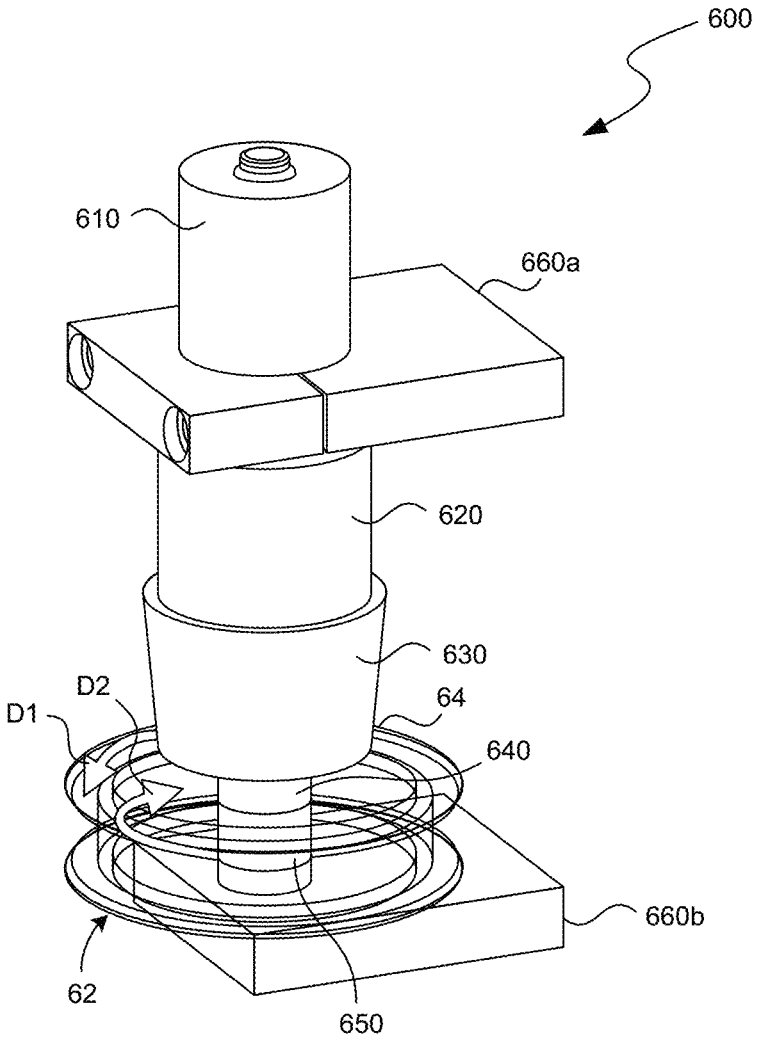
FIG. 3C is a detailed view showing an exemplary, optional retractor device that may be utilized with an embodiment of the present disclosure.

FIG. 3C is a perspective view of a retractor device 600 according to an embodiment of the present disclosure. The retractor device 600 may be electrically, pneumatically, mechanically (e.g., with a resilient element such as a torsion spring), or otherwise powered. The retractor device 600 shown in FIG. 3C includes a torque source 610, e.g., an electric motor, a torque multiplier 620, e.g., reduction gearing, a torque limiter 630, e.g., a friction plate slip-clutch, a coupling 640, and a one-way clutch 650, e.g., a drawn cup needle clutch bearing. One or more brackets 660 (two brackets 660*a* and 660*b* are shown in FIG. 3C) may support the retractor device 600 with respect to the housing 20. Certain embodiments of the retractor device 600 can include a 60-80 Watt direct current electric motor 610 rated at 3000 revolutions per minute and a 6:1 ratio planetary gear reducer 620. The coupling 640 can be a steel mandrel for transferring driving torque to a drive pulley 62 for winding a cable 64 on the drive pulley 62. An example of a drawn cup needle clutch bearing is part number RC-081208 manufactured by The Timken Company of Camden, Ohio. The one-way clutch 650 may be interposed between the coupling 640 and the drive pulley 62. Accordingly, operating the torque source 610 engages the one-way clutch 650 thereby driving the drive pulley 62 and winding the cable 64 onto the drive pulley 62 to retract the netting package 30. Moreover, the one-way clutch 650 allows the drive pulley 62 to turn generally freely to allow the cable 46 to pay-out when, for example, the netting package 30 is being deployed.

The electronics for the control of the device 10 can include at least two options for triggering deployment: (1) a wireless frequency operated button ("FOB") and/or (2) a wired control box. Embodiments of option 1 according to the present disclosure can include a three-channel, 303 MHz wireless radio frequency board (e.g., Model Number RCR303A manufactured by Applied Wireless, Inc. of Camarillo, Calif.) in the housing 20 and a three-button FOB (e.g., Key Chain Transmitter KTX303Ax also manufactured by Applied Wireless, Inc.) that can be separated and remotely located from the housing 20. Some other embodiments use radio frequency transmission equipment having a LINX RXM-418-LR 418 MHz receiver, CMD-KEY#-418-S5 transmitter, and LINX LICAL-DEC-MS001 decoder (which decodes the encrypted digital string sent by the transmitter). The wireless transmissions can be encoded at 24 bits (allowing for 16.7 million unique addresses) to negate the possibility of cross-talk between another nearby unit. Embodiments of option 2 according to the present disclosure can include a control box that can be separated and remotely located from the housing 20 but remains electrically coupled via a cable. Both options may be incorporated into the device 10 to provide a backup for controlling deployment of the netting package 30.

Figure 3D:
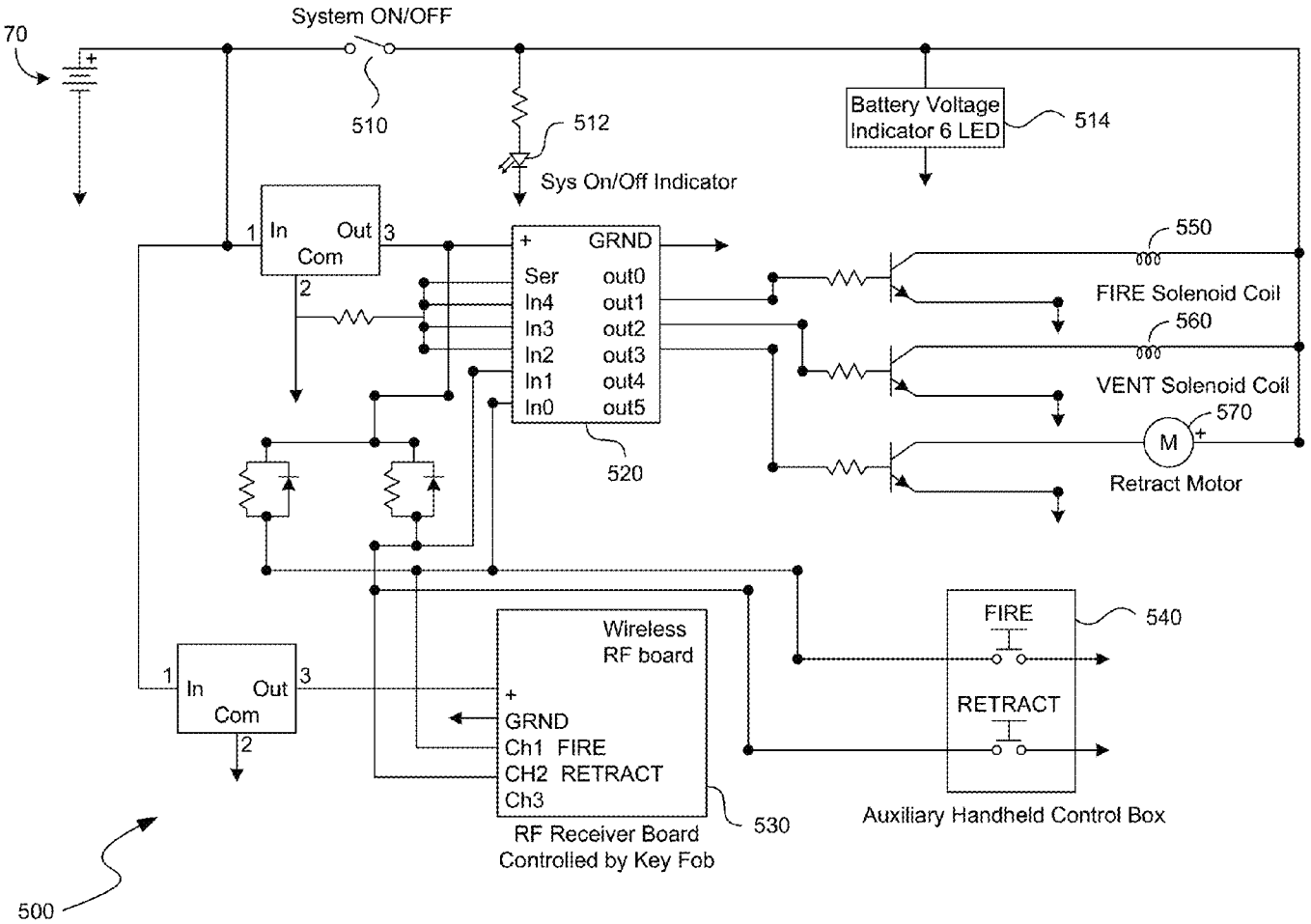
FIG. 3D is a schematic diagram showing an exemplary control system that may be utilized with an embodiment of the present disclosure.

FIG. 3D is a schematic diagram of an electronic circuit 500 for controlling the inflator device 400 and the retractor device 600 according to an embodiment of the present disclosure. The electronic circuit 500 shown in FIG. 3D includes the power supply 70, e.g., a 24 volt direct current battery, and a system switch 510 for turning ON/OFF the device 10. The electronic circuit 500 may also include a first indicator 512 for showing the status of the device 10 based on the setting of the system switch 510 and a second indicator 514 for showing the voltage of the power supply 70. A microprocessor 520 receives input signals, e.g., "FIRE" and "RETRACT," from a wireless radio frequency board 530 (i.e., option 1) and/or an auxiliary handheld control box 540 (i.e., option 2) and sends output signals to (a) a solenoid coil 550 for the deployment valve 432, (b) a solenoid coil 560 for the vent valve 440, and/or (c) a motor winding 570 for the torque source 610.

The electronic circuit 500 can also include circuitry to handle the timing and control of operational events. Such a circuit may be useful if, for example, there is a difference in voltage provided by the wired control box 540 (e.g., approximately 14-17 volts direct current) versus the voltage required to operate the deployment valve 432 and/or vent valve 440 (e.g., approximately 24 volts direct current). This other circuit operates based on operator input for each event from either the wireless radio frequency board 530 (i.e., option 1) and/or the wired control box 540 (i.e., option 2).

Figure 3E:
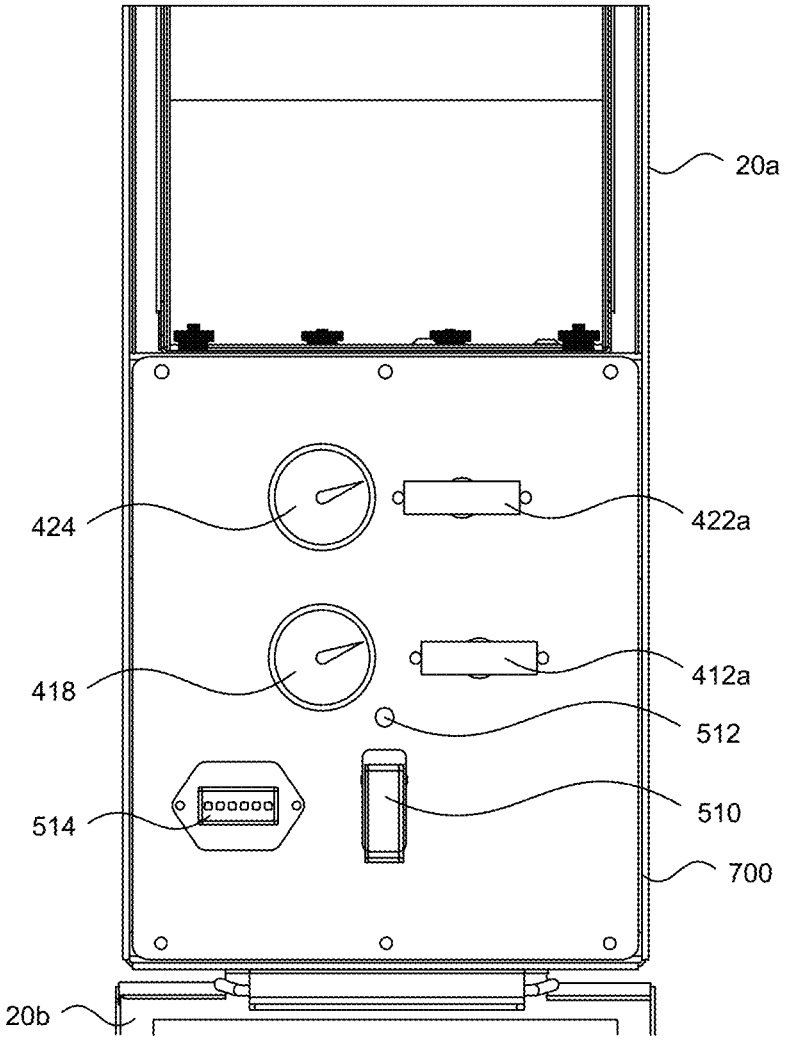
FIG. 3E is a partial plan view showing an exemplary control panel that may be utilized with an embodiment of the present disclosure.

FIG. 3E is a partial plan view showing a control panel 700 according to an embodiment of the present disclosure. The control 700 can be coupled to the housing 20 and include the gauge 418 to indicate the pressure in the high pressure reservoir 410, the gauge 424 to indicate the pressure in the accumulator tank 420, the second indicator 514 for showing the voltage of the power supply 70, the system switch 510, the first indicator 512 for showing the ON/OFF status of the device 10 based on the setting of the system switch 510, a knob 412*a* operating the supply valve 412 to supply or shutoff the flow of the compressed gas from the high pressure reservoir 410, and a knob 422*a* operating the drain valve 422 to drain residual pressure in the accumulator tank 420 and purge the inflator device 400, for example, when storing the device 10.

Figure 4A:
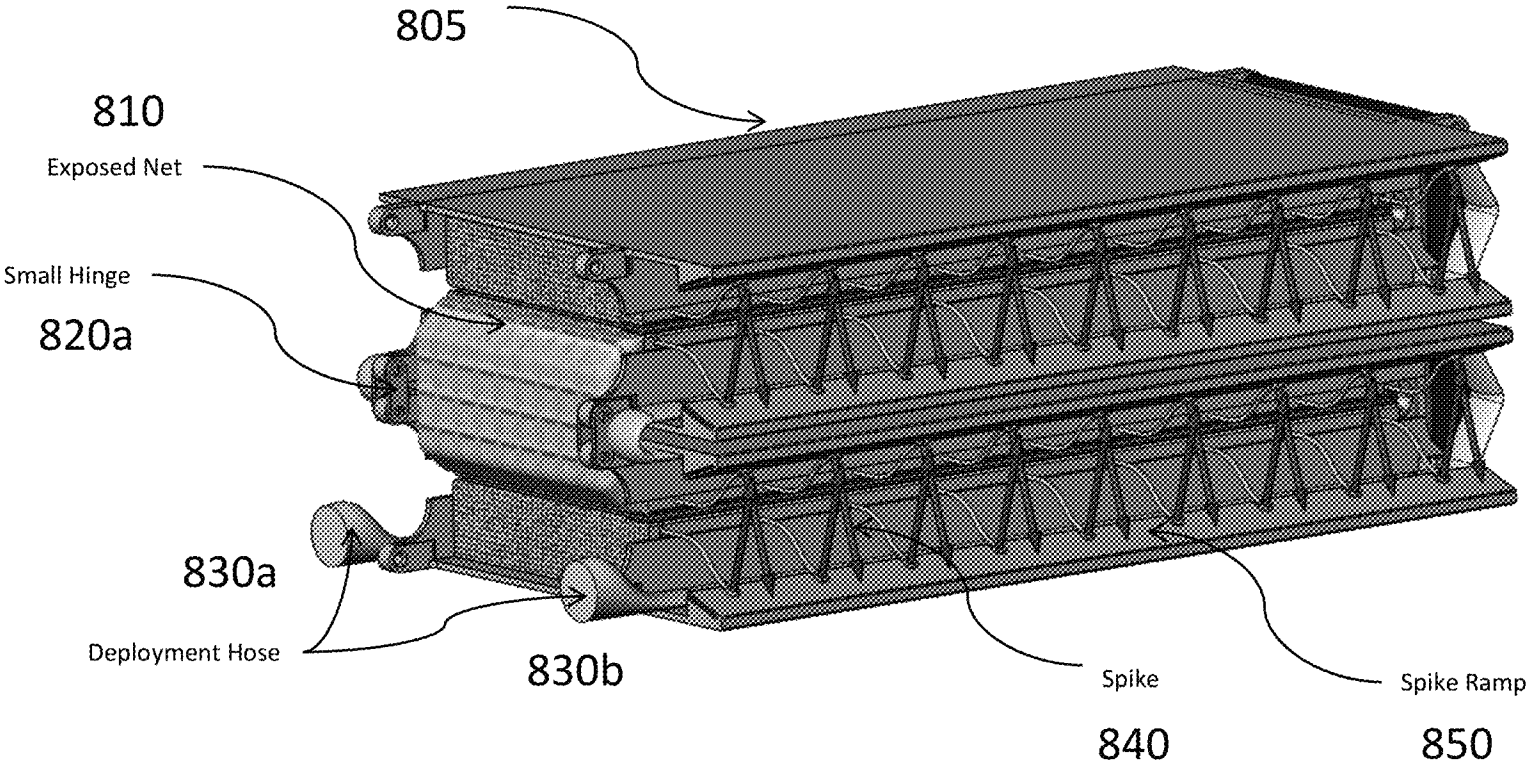
FIGS. 4A and 4B are side views of an arrangement of segments in a stacked configuration according to an embodiment of the present disclosure.
Figure 4B:
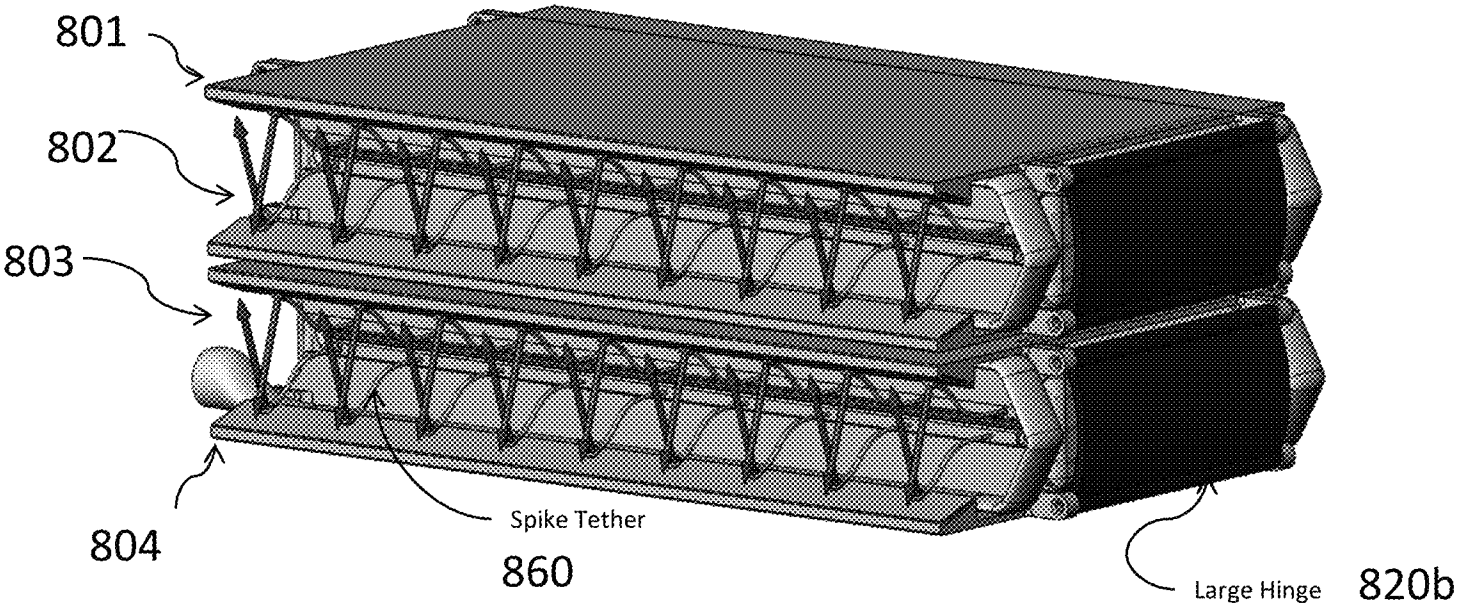

FIGS. 4A and 4B illustrate in further detail an exemplary subset of stacked (folded) segments that may be incorporated into a netting package 30 of device 10 in an undeployed state, As delineated in FIG. 4B, FIGS. 4A and 4B illustrate four stacked segments, 801, 802, 803, 804, arranged such that they are inverted lengthwise. Although four stacked segments are illustrated in FIGS. 4A and 4B, it will be appreciated that device 10 may incorporate more segments when the netting package is incorporated into device 10. The number of total segments to be included, and the length of each segment, will be determined such that the netting package, when unfurled for deployment, traverses the roadway, or at least a substantial width of the roadway, so that an oncoming vehicle will make contact with at least one of the segments. The length of each segment may be determined based in part upon weight and the ease and speed with which the segments will unfurl from the stacked position when the deployment hoses are inflated, and the ease of retracting the segments after the targeted vehicle has made contact with the device.

As can be seen in FIG. 4A, each segment may include a plate or backing 805. The plate incorporates hinge tabs or is otherwise affixed to tabs or some other mechanism to connect the segments together via hinges. In the embodiment depicted in FIGS. 4A and 4B, the plate is a rigid surface as described above with reference to FIG. 3A. In alternative embodiments, however, the backing may be made of a flexible material, or may be made of a strong cloth. A small hinge 820*a* can be used to connect the backing 805 at one end of a first segment to a second segment, and a large hinge 820*b* can be used to connect the other end of the backing 805 of the first segment to a third segment. As can be seen, the small hinge 820*a* connects the backings 805 of two segments arranged "back-to-back," whereas the large hinge 820*b* connects the backings 805 of two segments stacked "front-to-front."

Atop the backing 805, each segment will include netting 810, a portion of which will be exposed at the side where the small hinge 820*a* is located when the segments are in the stacked configuration. Additionally, the segments each contain a plurality of spikes, quills or other penetrators 840 capable of penetrating into the tires of the targeted oncoming vehicle. As can be seen, when the segments are in the stacked configuration, the spikes point toward the opposing segment. Sufficient spacing must be provided such that, when the segments are in the stacked configuration, they are not penetrating into the opposing segment in a manner that would prevent the segments from unfurling when the deployment hoses are being inflated.

As shown, the segments also include a spike ramp 850 at a leading edge of the backing 805. The spike ramp may be incorporated within the backing or may be made of a different material. The spike ramp holds a plurality of spikes in place, at an angle that facilitates having the spikes penetrate into the tires of an oncoming vehicle when the segments are unfurled for deployment.

As shown in FIG. 4B, each spike includes a spike tether 860, which connects the base of the spike to the netting 810. When the device 10 is deployed, at least one tire of an oncoming vehicle travels up the spike ramp 850 and is punctured by a spike 840. The spike is then lodged in the tire, and via the tether, the netting is pulled from the segment, as will be described in further detail below.

Lastly, FIGS. 4A and 4B show portions of the deployment hoses 830*a* and 830*b*, which run the length of the segments. At one end of the segments, the uninflated deployment hose will fold tightly near the small hinge 820*a*, from backing-to-backing of two segments. At the other end, the uninflated deployment hoses extend from the backing of one segment to the other, flanking the large hinge 820*b*.

Figure 4C:
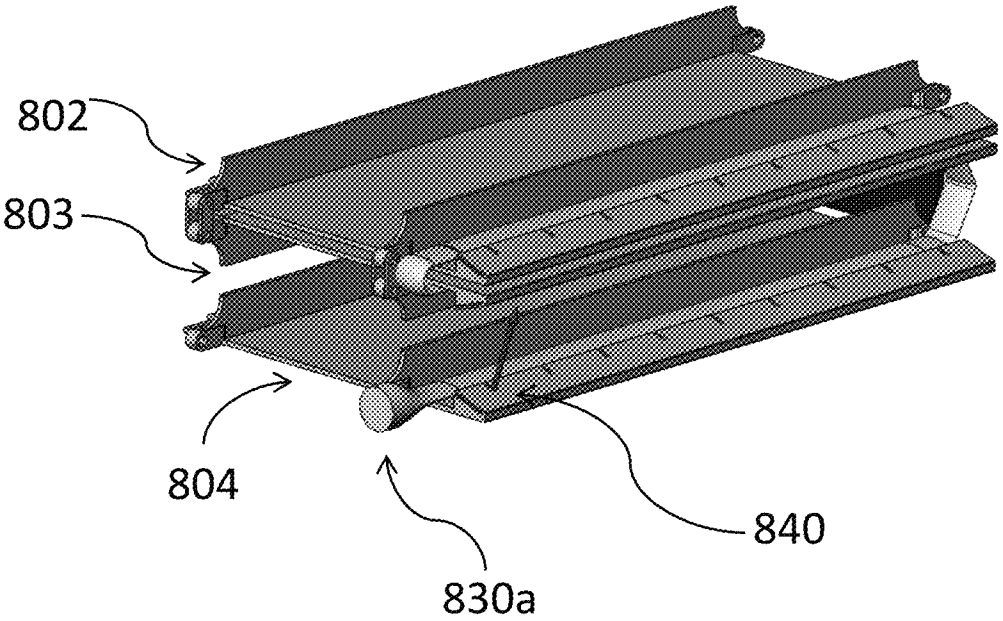
FIG. 4C is a side view of an arrangement of segments in a stacked configuration without netting according to an embodiment of the present disclosure.
Figure 4D:
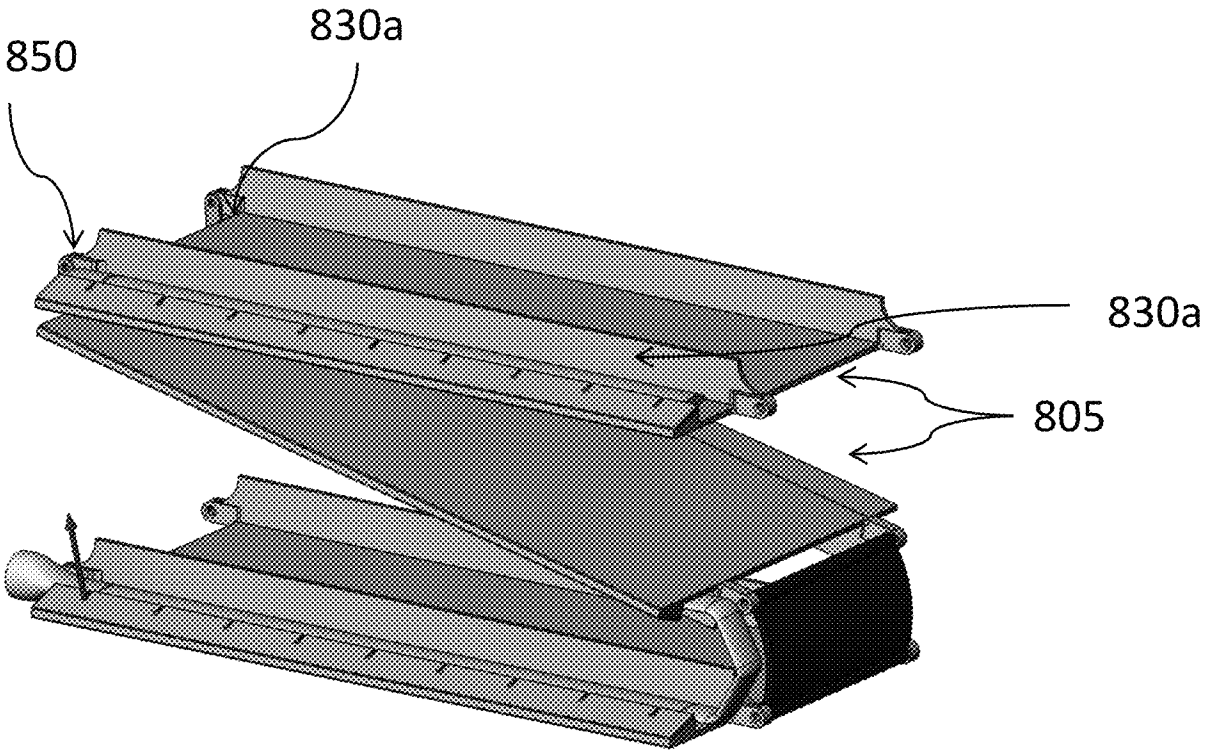
FIG. 4D is a side view of an arrangement of segments in a partially stacked configuration according to embodiments of the present disclosure.

FIGS. 4C and 4D illustrate the segments, with the netting removed. FIG. 4C illustrates three segments 802, 803, 804 in a stacked configuration, with the netting removed. A single deployment hose 830*a* and a single spike 840 is depicted. FIG. 4D illustrates the three segments, also with the netting removed, in a partially unstacked configuration. This provides a clear view of the rear side of the backing 805 of one segment as well as the front side of the backing for another segment. The front side of the backing 805 includes the spike ramp 850 and supports both deployment hoses 830*a* and 830*b*.

Figure 4E:
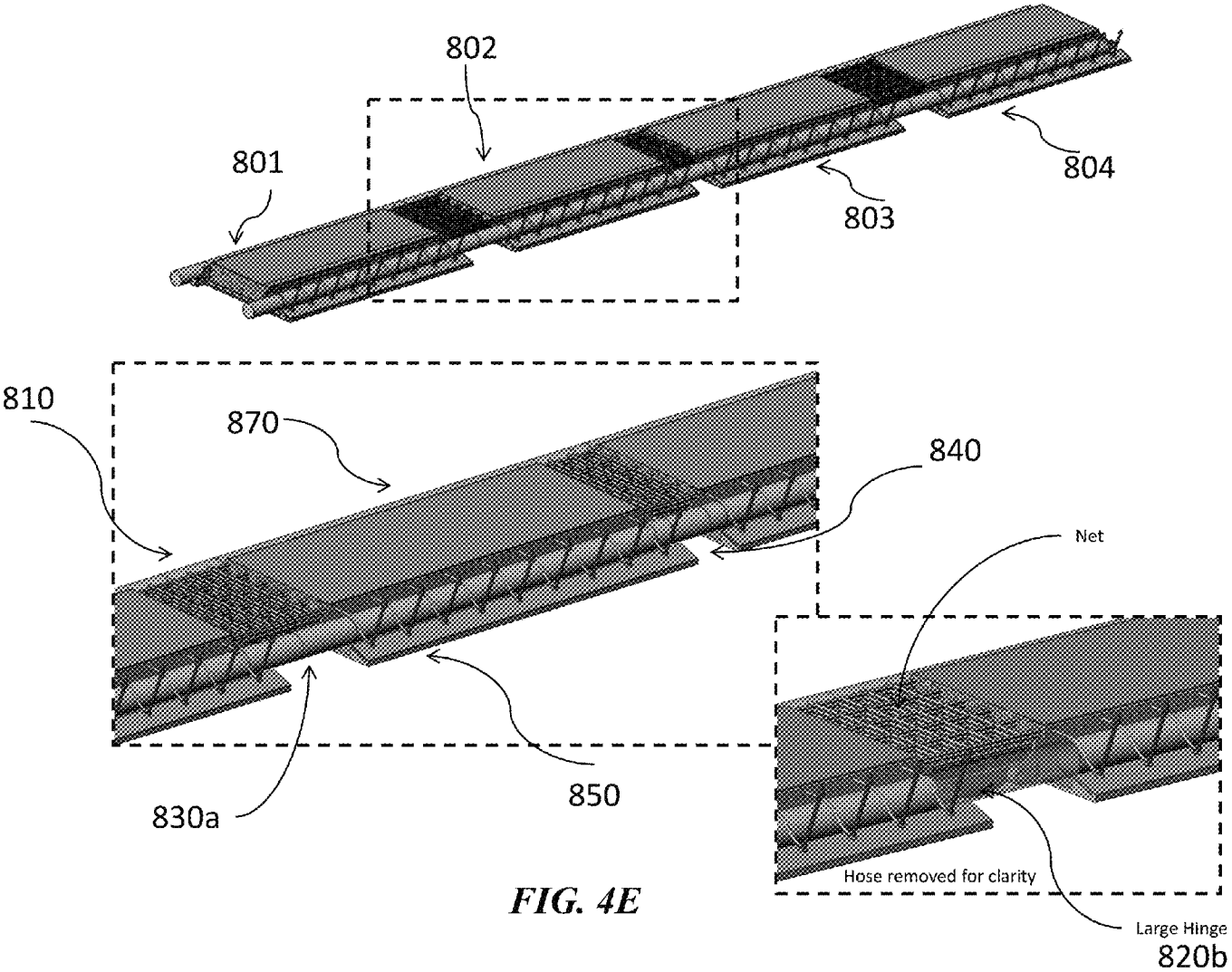
FIG. 4E is a side view of a plurality of segments in an unstacked configuration according to an embodiment of the present disclosure.

FIG. 4E illustrates four segments 801, 802, 803, 804 in an unstacked arranged, such as when in state that is ready for deployment. In this configuration, it can be seen that each deployment hose (such as 830*a*) is continuous from segment to segment. When unstacked, the spikes 840 are aligned facing the same direction, along with the spike ramp 850. The netting 810 is also continuous from segment to segment. FIG. 4E also shows an optional segment cover 860, which covers the segment itself but not the portion in which two segments are connected via a large hinge 820*b*. In some embodiments, the segment cover 870 may be part of the netting packaging. Or in other embodiments, no segment cover is required.

Figure 5:
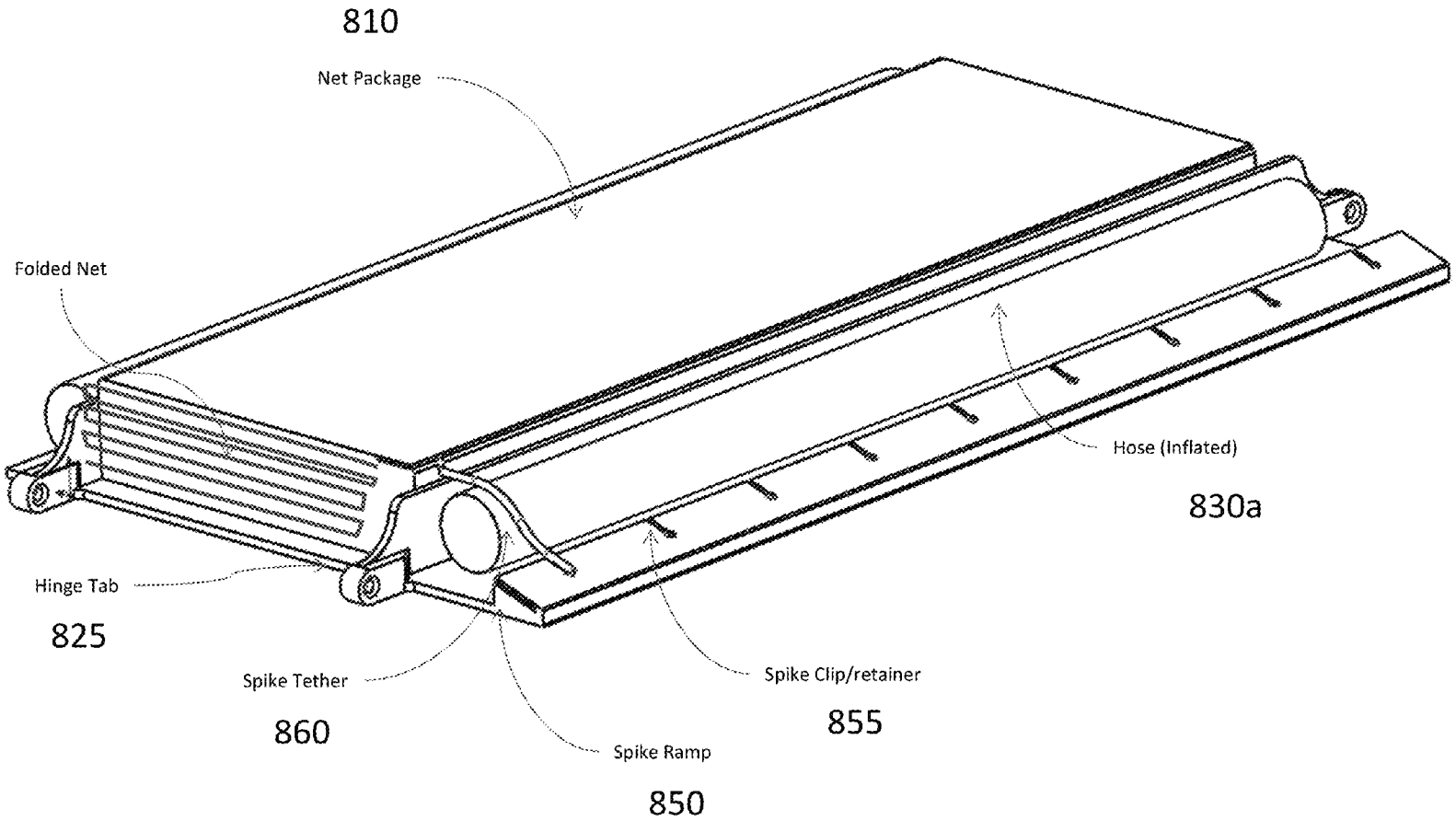
FIG. 5 is a view of a segment according to an embodiment of the present disclosure.

FIG. 5 provides a close-up view of a single segment that may be incorporated into device 10 in accordance with an embodiment of the disclosure. A portion of the net package 810 is housed by the segment (but the netting continues from segment to segment) and is folded so that it sits flush between the two deployment hoses (hose 830*a* is shown). Above the front deployment hose 830*a*, a plurality of spike tethers 860 connect the spikes (not shown) to the netting 810. The spikes sit in the spike ramp 850 and are retained via a series of spike clip/retainers 855 in the spike ramp so as to stay in place until one or more spikes is dislodged by penetrating the tire of an oncoming target vehicle.

Figure 6:
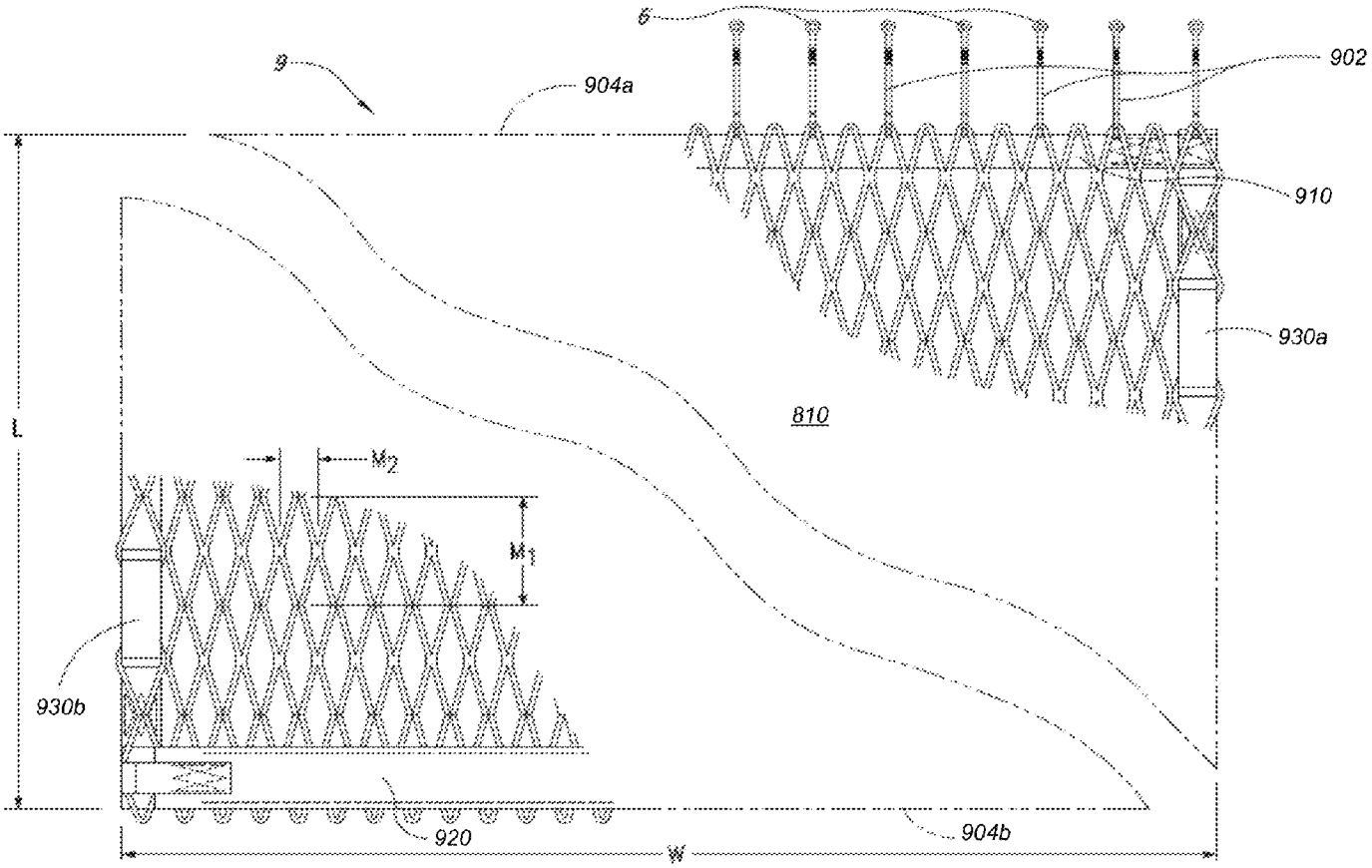
FIG. 6 is a partial view of an embodiment of exemplary netting that may be utilized in an embodiment of the present disclosure.

FIG. 6 is a partial plan view showing portions of opposite corners of an embodiment of the netting 810 in an extended, unfolded configuration. The netting 810 can be comprised of, for example, a polyethylene mesh net, having a width W preferably suitable for encompassing the track of the wheels of a target vehicle and a length L preferably suitable for extending at least approximately 1.25 times around the circumference of the wheels of the target vehicle. For example, if the target vehicle has a track of approximately 65 inches and rides on wheels having an outer diameter of approximately 28 inches, the net 700 may have a width W of approximately 190 inches and a length L of at least approximately 110 inches. The dimensions the net 810 may be selected in part based upon the width of the roadway and also the circumference of the wheel of the type of vehicle that is desired to be restrained by the device. A preferable minimum length of the net 700 in the example may be selected by computing 1.25 times the circumference of the wheel.

The net 810 can have meshes that, in the contracted, folded arrangement of the net, have an approximately diamond shape with a major axis M1 between distal opposite points approximately three to four times greater than a minor axis M2 between proximal opposite points. For example, the size of individual meshes in the widthwise direction may be approximately one inch in the contracted arrangement, e.g., stowed configuration, of the net 700, and the size of individual meshes in the lengthwise direction may be approximately 3.5 inches in the contracted arrangement of the net. Certain other embodiments according to the present invention may have approximately square shaped meshes.

The net 810 may be assembled according to known techniques such as using "Weavers Knots" and/or a "Fisherman's Knot" to join lengths of cord and form the mesh. Certain embodiments according to the present disclosure may include coating the net material with an acrylic dilution, e.g., one part acrylic to 20 parts water, to aid in setting the knots and prevent them from slipping or coming undone.

It may be desirable to provide a widthwise stretch ratio of approximately 3:1. Accordingly, each mesh is reshaped or stretches in the widthwise direction, e.g., parallel to the wheel track of the target vehicle, to a dimension approximately three times greater than its initial dimension. For example, a net having a 1.75 inch by 1.75 inch mesh size (unstretched) may be approximately 3.75 inches measured on the bias (stretched) when the net is entangled around the wheels of a target vehicle in the fully deployed configuration of the device 10. According to this example, approximately 65 inches of the contracted net that is captured by the wheel track of the target vehicle is expanded to approximately 245 inches that may become entangled on features of the undercarriage of the target vehicle approximately within its wheel track.

The netting may also include a first strip 910 along a leading edge 904*a* of the net 810, a second strip 920 along a trailing edge 904*b* of the net 810, and/or lengthwise strips 930 (individual lengthwise strips 930*a* and 930*b* are shown in FIG. 6). The first strip 910 may include, for example, approximately one inch wide nylon webbing that is sewn to the net 810 with rip-stitching. Accordingly, the style and/or material of the stitching securing the first strip 910 to the net 900 allows the first strip 910 to at least partially detach from the net 810 in response to the wheels of the target vehicle extracting the net 810 from the device. The second strip 920 includes a single strip extending approximately the entire width of the net 810. The second strip 920 may include, for example, approximately two inch wide nylon webbing that is securely sewn to the net 810 such that the second strip 920 remains at least approximately secured to the net 810 in response to the wheels of the target vehicle extracting the net 810 from the device. Individual lengthwise strips 930 may include single strips intertwined with the meshes of the net 810 between the first and second strips 910 and 920. The lengthwise strips 930 may be securely coupled to the first and second strips 910 and 920 such that the lengthwise strips 930 remain at least approximately secured to the first and second strips 910 and 920 in response to the wheels of the target vehicle extracting the net 810 from the device.

The first, second and/or lengthwise strips 910, 920 and 930 may maintain the approximate size and approximate shape of the net 810 in its contracted configuration, e.g., in a stowed configuration of the device. The second strip 920 that is secured to the trailing edge 904*b* of the net 810 may aid in cinching the net onto the wheels of the target vehicle so as to seize rotation of the entangled wheel(s) and thereby immobilize the target vehicle. The lengthwise strips 930 also may aid in cinching the netting onto the wheels of the target vehicle and/or minimize net flaring as the net 810 wraps around the wheels of the target vehicle.

Figure 7:
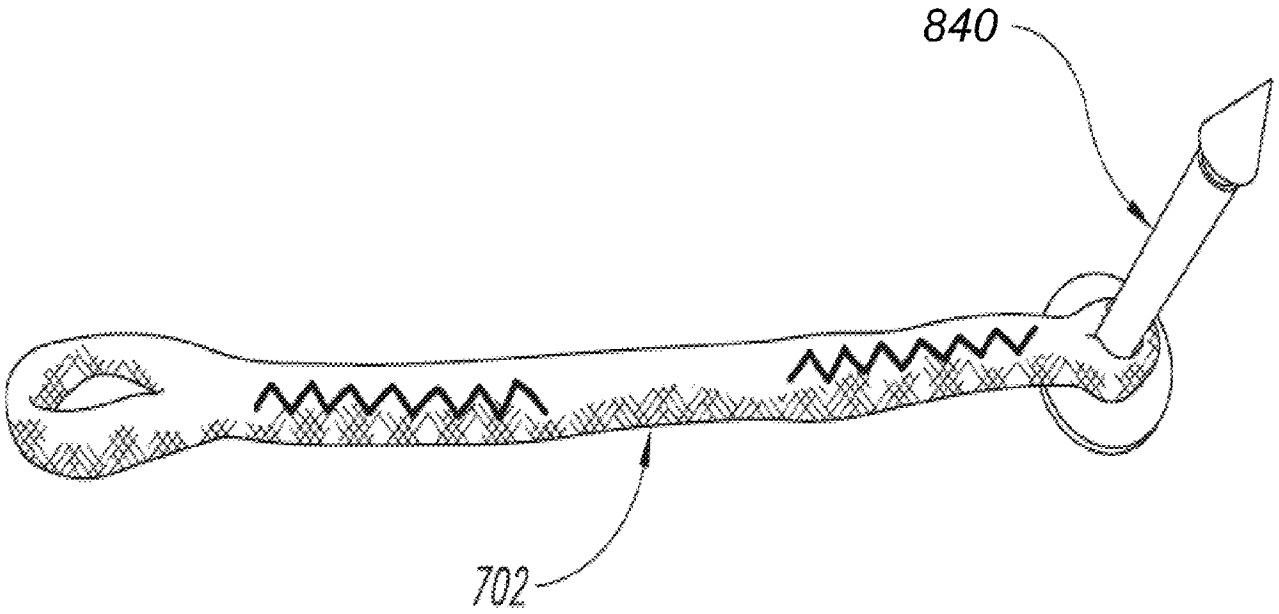
FIG. 7 is a perspective view of an embodiment of a tether and a spike for a snaring netting package that may be utilized in an embodiment of the present disclosure.

FIG. 7 is a detailed view of one embodiment of a tether 902 coupled to an individual spike 840. The tethers 860 may couple individual meshes at the leading edge 904*a* of the net to corresponding spikes 840. Individual tethers 860 may be made of the same material as the net or any other material that is suitable for coupling the spikes 840 and the net. Loops may be formed at either end of the tether 860 by known weaving or braiding techniques.

A method according to embodiments of the present disclosure for implementing a vehicle immobilizing device will now be described. A vehicle immobilizing device 10 is to be positioned in along the side of a roadway. In some embodiments, the device can be permanently left in position at the roadside, and may be disguised. In other instances, the device can be transported in the trunk of an automobile, such as a police car or military vehicle. When the police or military are engaged in a chase and need to restrain a vehicle, the device 10 can then be quickly positioned along the roadway in the expected path of the vehicle. When the device is in an undeployed state, it may be a completely enclosed box, resembling, for example, a suitcase. In this undeployed state, the segments contained therein, which include the netting 810, are in a stacked position inside the housing, as depicted in FIG. 3A.

Once the target vehicle is in close proximity to the device 10, the device can be deployed, either by a sensor, manually, or via remote control. Upon deployment, the inflator is powered and begins to quickly pump air into the deployment hoses 830. Because the hoses are folded multiple times, the hoses are inflated in sections. As each section is inflated, segments begin to rotate about the hinges 820*a* and 820*b* so as to unfold and lie end to end. Because the device is positioned along the roadway, the segments then lay in a linear fashion across the roadway, just at, or near the time that the target vehicle is approaching.

As the vehicle's tires make contact with segments of the device, the tires are lifted slightly by the spike ramp 850 and then make contact with at least one spike 840. In a preferred embodiment, the spikes 840 are placed sufficiently close together such that the vehicle's tires contact multiple spikes. The spikes penetrate into the front tires of the vehicle and become lodged in those tires. This cause the spikes to become dislodged from the spike clip/retainer 855 in the spike ramp 850.

As the spikes are drawn around the circumference of the tire, the base of the spikes pulls the spike tethers 860, which in turn is connected to the netting 810. The netting is then pulled from the segments. The netting has been folded in a manner that it will be drawn out from the net packaging in a continuous motion. As the netting is drawn from the device 10, it proceeds to wrap around the tire as it continues to rotate. The netting then proceeds to twist and becomes entangled around the rotating tires. The entangled snaring members then will continue to twist until leverage against the under carriage of the vehicle brings the tires to a stop. Accordingly, the vehicle can be slowed and stopped in a controlled and non-lethal manner.

The above detailed description of embodiments is not intended to be exhaustive or to limit the invention to the precise form disclosed above. Also, well-known structures and functions have not been shown or described in detail to avoid unnecessarily obscuring the description of the embodiments of the present disclosure. While specific embodiments of, and examples for, the invention are described above for illustrative purposes, various equivalent modifications are possible within the scope of the invention, as those skilled in the relevant art will recognize. As an example, certain embodiments of devices according to the present disclosure may include a pressure generator disposed in a device control housing with other operating elements, such as, but not limited to, a pressure delivery manifold, control circuitry to arm and deploy, a proximity detector, a signal receiving and sending circuit and any other hardware, software or firmware necessary or helpful in the operation of the device. As another example, the device may be housed in a clamshell-type briefcase or ammunition box type housing and include a pressure manifold and a pressure-generating device, such as compressed gas or a gas generator connected to the manifold. In other embodiments more than one manifold and more than one pressure generating device, or any combination thereof, may be included in the device.

Unless the context clearly requires otherwise, throughout the description and the claims, the words "comprise", "comprising", and the like are to be construed in an inclusive sense, as opposed to an exclusive or exhaustive sense; that is to say, in the sense of including, but not limited to. Additionally, the words "herein", "above", "below", and words of similar connotation, when used in the present disclosure, shall refer to the present disclosure as a whole and not to any particular portions of the present disclosure. Where the context permits, words in the above Detailed Description using the singular or plural number may also include the plural or singular number respectively. The word "or", in reference to a list of two or more items, covers all of the following interpretations of the word: any of the items in the list, all of the items in the list, and any combination of the items in the list.

While certain aspects of the invention are presented below in certain claim forms, the inventors contemplate the various aspects of the invention in any number of claim forms. Accordingly, the inventors reserve the right to add additional claims after filing the application to pursue such additional claim forms for other aspects of the invention.

The invention claimed is:

1. An apparatus to be positioned at the side of a roadway for ensnaring tires of an oncoming land vehicle, comprising:

a platform supporting a netting package and a plurality of penetrators; and a deployment module configured to cause the platform to lay across the roadway upon deployment, wherein the penetrators are tethered to netting in the netting package and positioned such that, upon deployment, the penetrators puncture a tire of an oncoming land vehicle and cause the netting to be pulled away from the platform to ensnare the tire.

2. The apparatus of claim 1, wherein the platform is comprised of a plurality of segments arranged in a condensed configuration when in a non-deployment state.

3. The apparatus of claim 1, wherein the platform includes a deployment hose and the deployment module is configured to inflate the deployment hose upon deployment.

4. The apparatus of claim 1, wherein the segments are attached end-to-end.

5. The apparatus of claim 4, wherein each segment supports a portion of the netting.

6. The apparatus of claim 1, wherein the segments are arranged in a stacked configuration when in an non-deployment state.

7. The apparatus of claim 1, wherein the plurality of penetrators are spikes.

8. The apparatus of claim 2, wherein the platform further comprises a backing having a spike ramp at a leading edge to hold the spikes in place at an angle that facilitates having the spikes penetrate into the tires of an oncoming vehicle upon deployment.

9. The apparatus of claim 1, wherein the platform is comprised of a plurality of segments, each having a backing.

10. The apparatus of claim 1, wherein the netting is drawn from the platform in continuous motion.

11. The apparatus of claim 1, wherein the netting is configured to twist and become entangled around rotating tires.

12. The apparatus of claim 1, wherein the penetrators are placed sufficiently closely together such that the vehicle's tires contact multiple spikes.

13. An apparatus comprising:

a plurality of segments comprising a backing and a spike positioning retainer; and a deployment hose attached along a side thereof to at least one of said plurality of segments;

wherein said plurality of segments are adapted to house a netting package supported by the backing and a plurality of spikes held by the spike positioning retainer, wherein, upon deployment, the spikes puncture a tire of an oncoming land vehicle and cause netting in the netting package to be pulled away from the segments to ensnare the tire.

14. The apparatus of claim 13, wherein the plurality of spikes are tethered to the netting, and the spike positioning retainer positions the spikes tethered to the netting.

15. The apparatus of claim 13, wherein the deployment hose is configured to be connected a pressure-generating device to be inflated.

16. An apparatus to be positioned at the side of a roadway for ensnaring tires of an oncoming land vehicle, comprising:

a platform supporting a netting; and a deployment module configured to cause the platform to lay across the roadway upon deployment, wherein, upon deployment, the netting is caused to become pulled away from the platform to ensnare the tire.

17. The apparatus of claim 16, wherein the netting includes lengthwise strips to aid in cinching the netting onto wheels when ensnaring the tire.

18. The apparatus of claim 16, wherein the platform is comprised of a plurality of segments connected end to end.

19. The apparatus of claim 16, the apparatus further comprising electronic circuitry for automatically triggering the deployment module.

* * * * *